United States Patent [19]

Vaguine

[11] 4,024,426

[45] May 17, 1977

[54] STANDING-WAVE LINEAR ACCELERATOR

[75] Inventor: Victor A. Vaguine, Palo Alto, Calif.

[73] Assignee: Varian Associates, Inc., Palo Alto, Calif.

[22] Filed: Feb. 3, 1975

[21] Appl. No.: 546,379

Related U.S. Application Data

[63] Continuation of Ser. No. 420,754, Nov. 30, 1973, abandoned.

[52] U.S. Cl. ..... 315/5.41; 315/5.42; 328/233

[51] Int. Cl.[2] ..... H01J 25/10

[58] Field of Search ..... 315/5.41, 5.42, 3.5 X; 313/63; 328/233

[56] References Cited

UNITED STATES PATENTS

| | | | |
|---|---|---|---|
| 2,556,978 | 6/1951 | Pierce | 315/5.42 |
| 2,922,921 | 1/1960 | Nygard | 315/5.42 |
| 3,264,568 | 8/1966 | Goerz, Jr. et al. | 315/5.42 X |
| 3,324,340 | 6/1967 | Pinel et al. | 313/63 X |
| 3,546,524 | 12/1970 | Stark | 315/5.41 |
| 3,906,300 | 9/1975 | Tran | 315/5.41 |

*Primary Examiner*—Saxfield Chatmon, Jr.
*Attorney, Agent, or Firm*—Stanley Z. Cole; Leon F. Herbert; John J. Morrissey

[57] ABSTRACT

A standing-wave linear charged particle accelerator is disclosed which comprises a plurality of interlaced substructures, with each substructure having a plurality of accelerating cavities disposed along the particle beam path and having side cavities disposed away from the beam path for electromagnetically coupling the accelerating cavities. A standing radio-frequency electromagnetic wave is supported in each substructure, with the wave in each substructure being phase with respect to the wave in every other substructure so that the particle beam will experience a maximum energy gain throughout its path through the accelerator. This interlaced substructure configuration minimizes the transit time of the particles across the gap of each accelerating cavity and makes it possible to operate the accelerator without radio-frequency breakdown at a power level that provides a substantially higher average value of the accelerating electric field along the beam path than has heretofore been obtainable.

14 Claims, 6 Drawing Figures

FIG.3
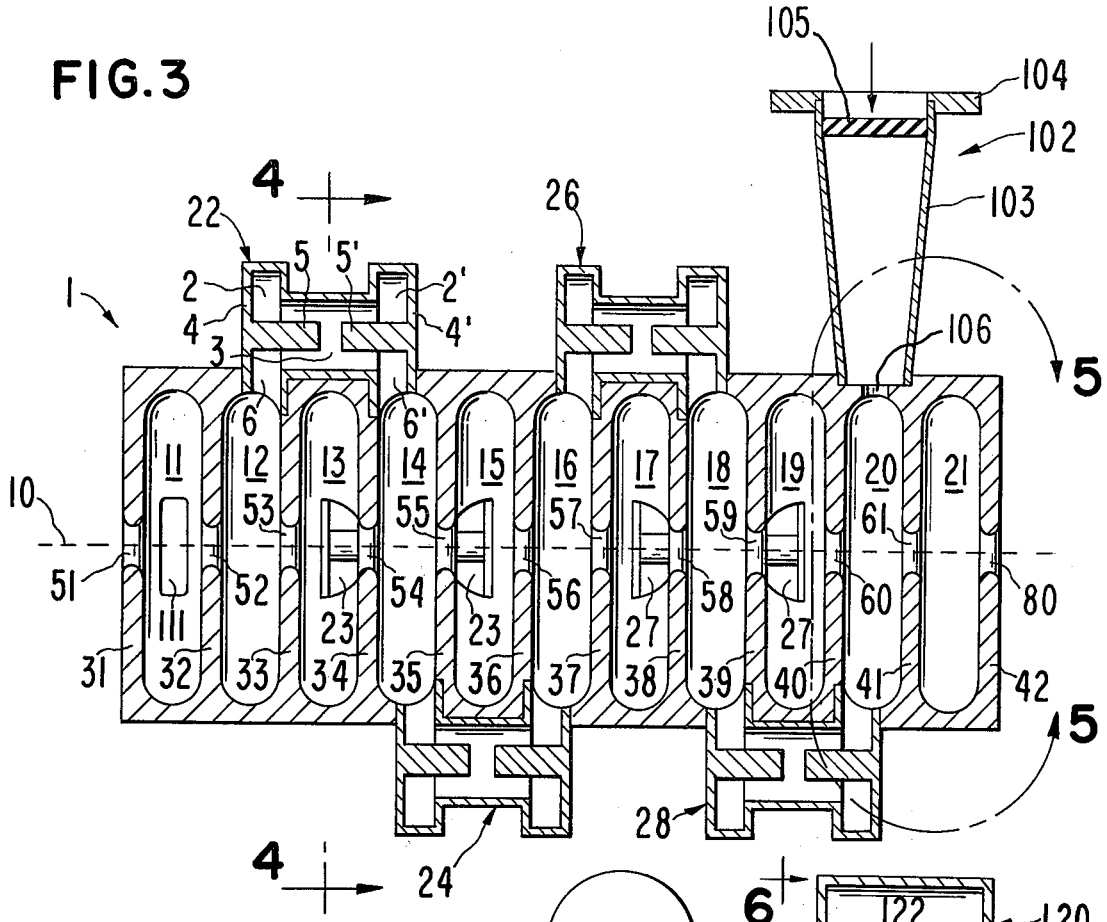
FIG.4
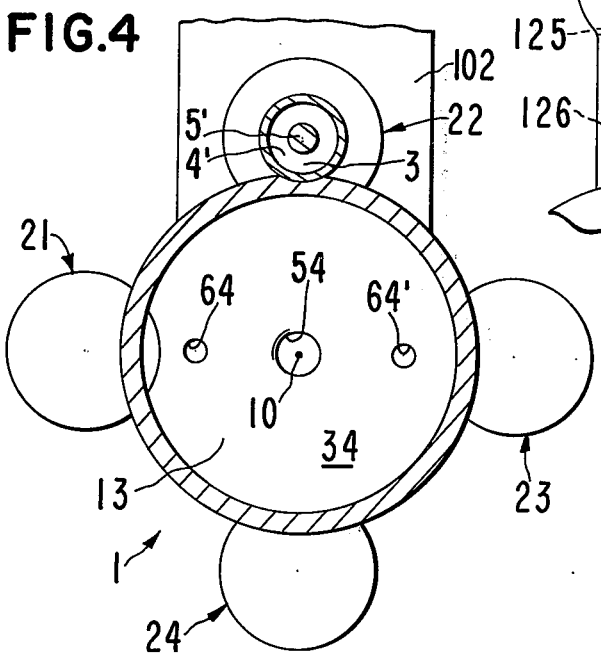
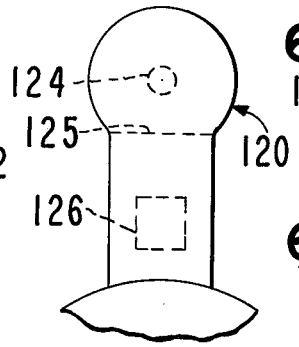
FIG.6
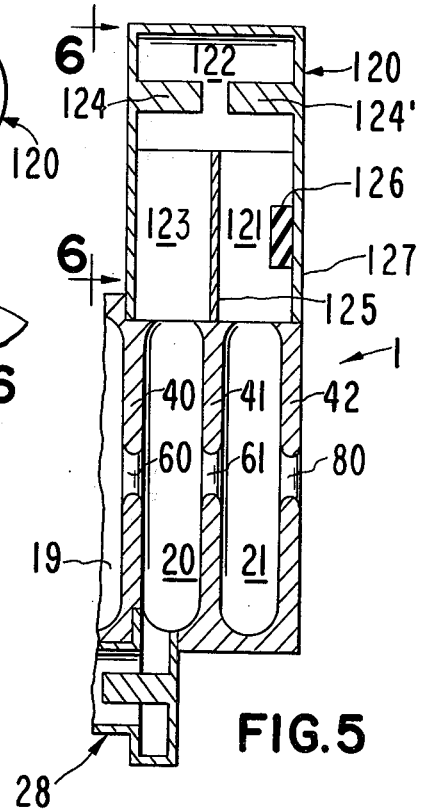
FIG.5

STANDING-WAVE LINEAR ACCELERATOR

This is a continuation of application Ser. No. 420,754 filed Nov. 30, 1973, now abandoned.

BACKGROUND OF THE INVENTION

This invention is a further development in the standing-wave linear charged particle accelerator art.

Since the earliest days of linear accelerator technology, beams of charged particles have been accelerated by the repeated application of electrical pulses at successive positions along the beam path through the accelerator structure. Various accelerator configurations have been developed to support an accelerating electric field along the beam path. The Sloan-Lawrence configuration, P. H. Sloan and E. O. Lawrence, 38 *Physical Review* 2021 (1931); the Alvarez cavity resonator configuration, L. W. Alvarez, 70 *Physical Review* 799 (1946); and the iris-loaded travelling-wave accelerator, E. L. Ginzton, W. W. Hansen and W. R. Kennedy, 19 *Review of Scientific Instruments* 89 (1948), are well-known. More recently, the side-cavity coupled accelerator configuration as described by E. A. Knapp, B. C. Knapp and J. M. Potter in an article entitled "Standing Wave High Energy Linear Accelerator Structures," 39 *Review of Scientific Instruments* 979 (1968), has found wide application.

The early standing-wave linear accelerators provided a succession of accelerating cavities and coupling cavities located one after the other along the length of the accelerator. Particles to be accelerated would travel first through an accelerating cavity and then through a coupling cavity in repeated succession throughout the length of the accelerator. Energy could be absorbed by the particles only in the accelerating cavities. Consequently, the coupling cavities had the effect of contributing to the overall length of the accelerator structure without imparting any accelerating force to the particles. It was subsequently realized that the coupling cavities could be disposed as side cavities away from the path of the particle beam. By positioning the coupling cavities away from the beam path, the overall length of the accelerator could be reduced. With the beam thus passing through accelerating cavities only, and not passing through coupling cavities, the energy gain of the beam per unit length of the accelerator could be increased. The side-cavity coupling technique thereby provided more efficient utilization of the radio-frequency power than had previously been possible. With side-cavity coupling, the beam was exposed to an accelerating electric field from which energy could be absorbed throughout the entire path length of the beam through the accelerator except for those portions of the beam path between adjacent accelerating cavities.

The energy absorbed by charged particles in an accelerating cavity is related to the time of flight of the particles across that cavity, so that an increase in the gap between the entrance and exit apertures of an accelerating cavity, can result in a decrease in the energy gain of the particles in that cavity. Present-day side-cavity coupled accelerator structures frequently employ drift tubes between adjacent accelerating cavities in order to optimize the energy gain in each accelerating cavity. Drift tubes are effective in correcting the adverse consequence of the lengthening of the accelerating cavities on the time of particle flight, and they also tend to concentrate the accelerating electric field within the immediate vicinity of beam path. However, drift tubes extend well into the accelerating cavities and typically occupy as much as one-third the overall length of the accelerator. Since the particles experience a substantially zero electric field intensity within the drift tubes, the particles do not acquire any energy during their passage through the drift tubes. Furthermore, drift tubes cause a high concentration of the electric field distribution at the entrance and exit apertures of the accelerating cavities, i.e., at the drift tube openings. This concentration of the electric field at the entrance and exit apertures of the accelerating cavities causes a reduction in the power level at which the accelerator can be operated without radio-frequency breakdown. The maximum permissible power level at which an accelerator may be operated without incurring radio-frequency breakdown determines the upper limit of the accelerating electric field that can be maintained along the beam path, and hence determines the maximum energy gain per unit path length of the beam through the accelerator. Maximization of the beam energy gain per unit accelerator length is especially important in applications such as radiation therapy where it is desirable to provide an accelerator structure that is as short as possible so that the accelerator structure can be rotatable in several planes within confined regions.

SUMMARY OF THE INVENTION

It is an object of this invention to provide a standing-wave linear charged particle accelerator that is capable of operating at power levels higher than have heretofore been possible without incurring radio-frequency breakdown.

It is a concomitant object of this invention to provide a standing-wave linear accelerator that is capable of imparting to a beam of charged particles a higher energy gain per unit path length through the accelerator than has heretofore been possible.

It is likewise an object of this invention to provide a side-cavity coupled standing-wave linear accelerator wherein concentration of the electric field distribution at the entrance and exit apertures of the accelerating cavities is minimized.

It is a further object of this invention to provide a side-cavity coupled standing-wave linear accelerator wherein the energy gain per unit path length of a beam of charged particles through the accelerator is maximized.

It is also an object of this invention to provide a side-cavity coupled standing-wave linear accelerator in which that portion of the beam path for which the beam experiences no accelerating electric field is minimized.

It is an important feature of this invention that the maximum permissible value for the accelerating electric field that can be tolerated by the accelerator disclosed herein without incurring radio-frequency breakdown approaches the peak value of the electric field that occurs somewhere on the internal surfaces of the accelerating cavities.

It is an object of this invention to provide a standing-wave linear accelerator which utilizes radio-frequency power more efficiently, i.e., which provides a higher beam energy gain per unit accelerator length for a given input power level, that has heretofore been possible with side-cavity coupled accelerator structures.

It is a feature of this invention that the charged particles to be accelerated will experience an accelerating electric field for substantially their entire path through the accelerator. Discontinuities in the accelerating electric field will occur at the irises between adjacent accelerating cavities, but the sum of all these regions of accelerating field discontinuity is very small in comparison with the total length of the beam path through the accelerator.

Another object of this invention is to provide a charged particle accelerator structure comprising a plurality of accelerating substructures, wherein each substructure supports a standing electromagnetic wave in phased relationship with a standing electromagnetic wave in every other substructure, and wherein the accelerating cavities of the substructures are interlaced so that each accelerating cavity of one substructure is adjacent an accelerating cavity of another substructure along the path of the charged particle beam through the accelerator.

It is a further object of this invention to provide a charged particle accelerator structure comprising a plurality of accelerating substructures, wherein the accelerating cavities of the various substructures are interlaced with respect to each other along the particle beam path and the coupling cavities of each substructure are disposed as side cavities away from the beam path through the accelerator.

An additional feature of this invention is that the phase difference between the standing waves in the adjacent accelerating cavities of different substructures can be adjusted to control the energy gain of the beam of charged particles passing through the accelerator.

Another object of this invention is to provide a charged particle accelerator structure comprising a plurality of accelerating substructures, wherein the accelerating cavities of the various substructures are interlaced so that each accelerating cavity of one substructure is adjacent an accelerating cavity of another substructure along the beam path through the accelerator, with adjacent accelerating cavities of different substructures being electromagnetically discoupled from each other.

Yet another object of this invention is to provide a means for supplying two or more independent microwave energy inputs to a charged particle linear accelerator, whereby the charged particle beam will be accelerated by the microwave energy of one input in one portion of the accelerator and by the microwave energy of another input portion of the accelerator.

This invention teaches that by interlacing the accelerating cavities of a plurality of independent electromagnetically discoupled substructures disposed along the path of the particle beam through the accelerator, and by energizing each of these substructures with a standing electromagnetic wave in phased relationship with a standing electromagnetic wave in each of the other substructures, the maximum permissible power level at which the accelerator may be operated without incurring radio-frequency breakdown can be significantly increased.

Two or more independent side-cavity coupled substructures can be combined to form a single overall accelerator structure, with each substructure being energized with radio-frequency power in phased relationship with the other substructures. The resulting overall structure may be operated in the $\pi/2$-mode with respect to dispersion characteristics. In general, it is preferable that the substructures be electromagnetically discoupled in order that the phase of the wave in one substructure may be controllably variable with respect to the phase of the wave in any other substructure, at least in the case of very small beam loading (i.e., when the beam current is very small). However, in some applications, a certain amount of electromagnetic coupling between adjacent accelerating cavities of different substructures would be tolerable or even desirable.

In the case of a two-substructure accelerator according to the present invention, the transit-time factor very nearly approaches the value 1 for relativistic particles (e.g., electrons) and is substantially higher for nonrelativistic particles than is possible for accelerators of the prior art. Thus, especially for heavy particles, the present invention allows a significantly greater energy gain per unit length than has heretofore been possible. Furthermore, the higher transit-time factor (i.e., shorter time of flight) of the present invention eliminates the need for drift tubes between adjacent accelerating cavities, and thereby permits the use of rounded iris openings to minimize the electric field concentration at the entrance and exit apertures of each accelerating cavity. This feature substantially increases the level of radio-frequency power than can be handled by the accelerator structure without electrical breakdown. Furthermore, the use of rounded iris openings in place of drift tubes serves to provide a substantially uniform accelerating electric field throughout the accelerator along the path of the charged particles. This uniform electric field approaches the value of the peak radio-frequency field located on the iris roundings.

Other objects and advantages of this invention will be apparent upon a reading of the following specification in conjunction with the accompanying drawing.

BRIEF DESCRIPTION OF THE DRAWING

FIG. 3 is a sectional view of the accelerator taken on line 3—3 of FIG. 2.

FIG. 4 is a sectional view of an accelerating cavity of the accelerator taken on line 4—4 of FIG. 3.

FIG. 5 is a fragmentary sectional view delineated by line 5—5 of FIG. 3 showing an alternative embodiment of this invention.

FIG. 6 is an external view taken along line 6—6 of FIG. 5 showing the internal features of that embodiment in dotted lines.

DESCRIPTION OF A PREFERRED EMBODIMENT

Figure 1:
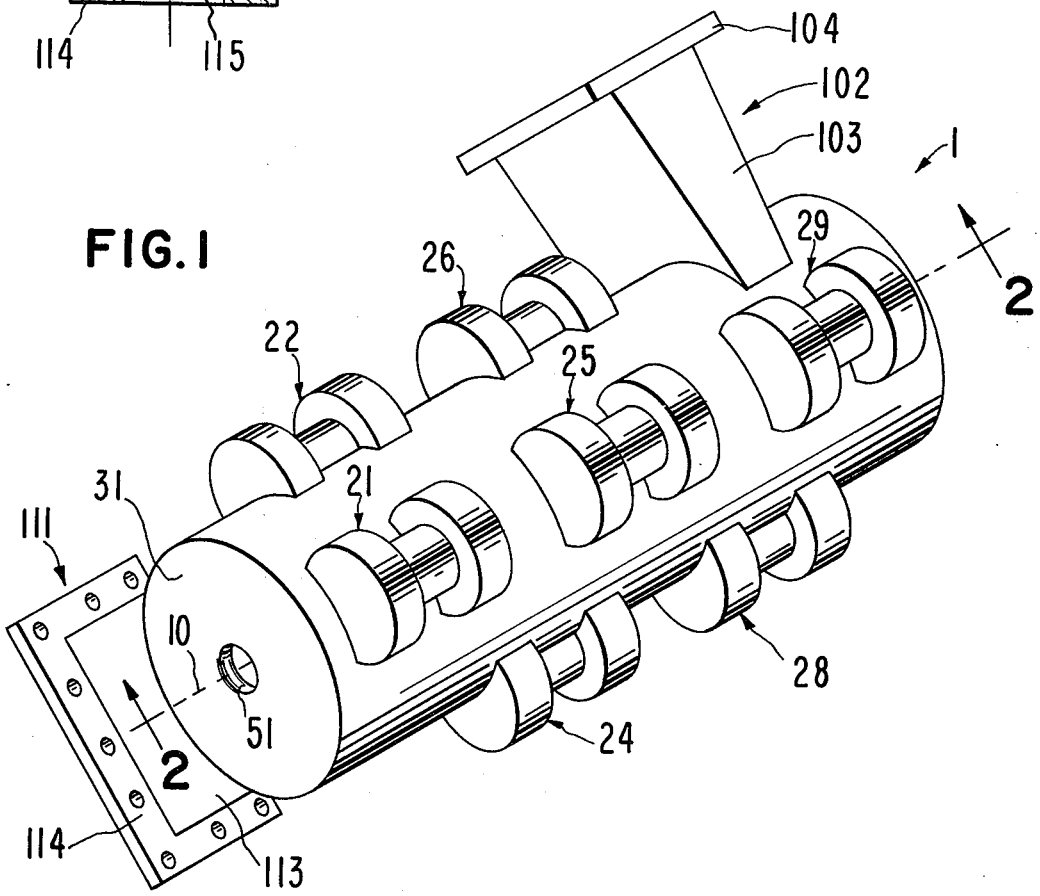
FIG. 1 is an oblique view of a standing-wave linear particle accelerator having two independent side-cavity coupled substructures interlaced according to this invention.

FIG. 1 shows an oblique view of a preferred embodiment of a standing-wave linear particle accelerator according to the teaching of this invention. The accelerator 1 has two interlaced side-cavity coupled standing-wave substructures, with the side cavities of each substructure being disposed orthogonally with respect to the side cavities of the other substructure along a common axis 10. The axis 10 also defines the path of the charged particle beam through the accelerator 1. Each substructure comprises a series of accelerating cavities, with the accelerating cavities of one substructure being interlaced with the accelerating cavities of the other substructure as will be discussed in connection with FIGS. 2 and 3. For each substructure, the accelerating cavities are inductively coupled by side cavities. The side cavities are seen in FIG. 1 as projections from the generally cylindrical overall configuration of the accelerator 1. The accelerating cavities of one substructure, however, are electromagnetically discoupled from the accelerating cavities of the other substructure.

Also shown in FIG. 1 are radio-frequency power input guides 102 and 111 for energizing, respectively, each of the standing-wave substructures. A conventional charged particle source, e.g., an electron gun, not shown, injects a pulsed beam of charged particles through a beam entrance aperture 51 into the accelerator 1 along axis 10 from left to right as viewed in FIGS. 1, 2 and 3. The injected beam pulses can be phased with respect to radio-frequency power input sources, e.g., klystrons, not shown, which supply power to the guides 102 and 111, so that the charged particles of each pulse will pass through each successive accelerating cavity during a time interval when the electric field intensity in that cavity is a maximum. It is desirable that in each accelerating cavity the particles experience the maximum electric field intensity possible for the particular power level at which the accelerator 1 is being operated. In that way, the electromagnetic interaction of the charged particles with the electric field will result in the greatest possible transfer in energy from the field to the particles.

Figure 2:
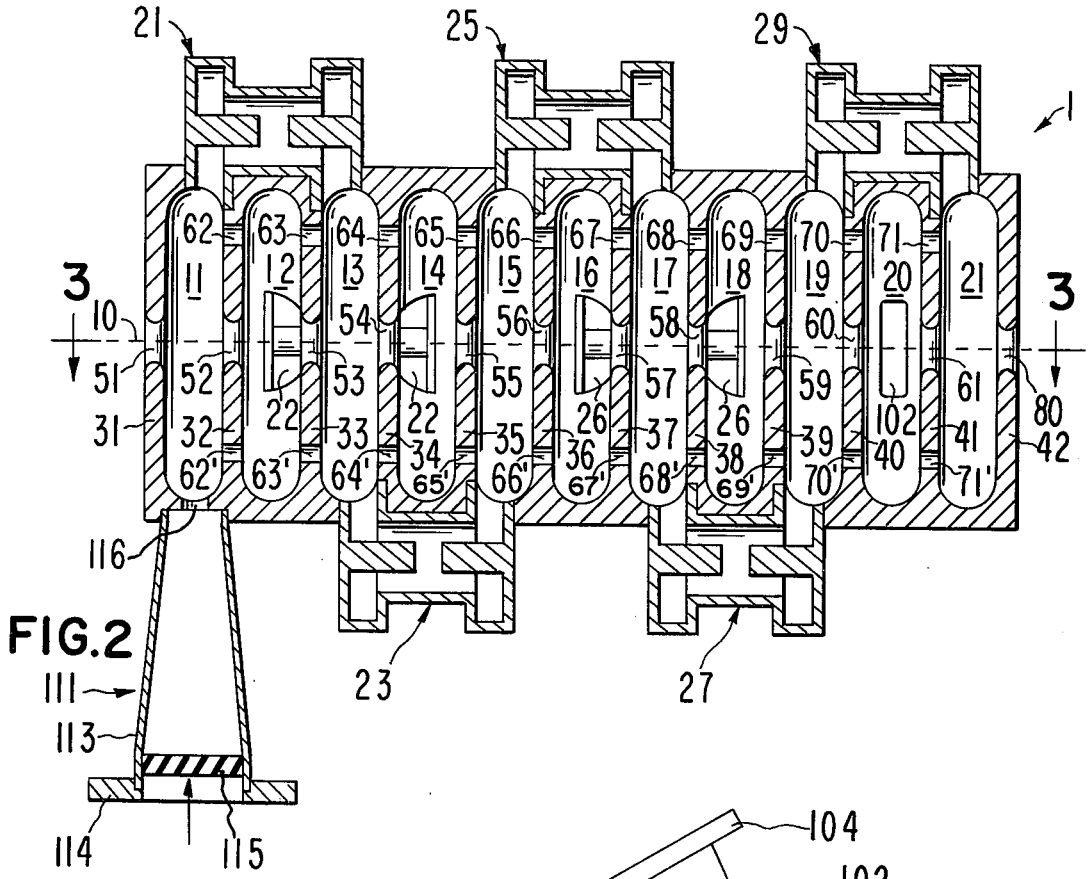
FIG. 2 is a sectional view of the accelerator taken on line 2—2 of FIG. 1.

FIG. 2 shows a cross-sectional view of accelerator 1 along the axis 10 of the particle beam. In the particular embodiment shown, there are eleven accelerating cavities 11, 12, 13, 14, 15, 16, 17, 18, 19, 20 and 21. The odd-numbered accelerating cavities form one standing-wave substructure, and the even-numbered accelerating cavities form another independent standing-wave substructure. The odd-numbered accelerating cavities are electrically coupled together by side cavities 21, 23, 25, 27 and 29. FIG. 3 shows another cross-sectional view of accelerator 1 along the axis 10 of the particle beam, orthogonal to the cross-sectional view of FIG. 2. In FIG. 3, the even-numbered accelerating cavities are shown electrically coupled together by side cavities 22, 24, 26 and 28. Each of the accelerating cavities 11 through 21 has a cylindrical configuration, and all these accelerating cavities are coaxially aligned along the axis 10.

The first cavity 11 has an entrance wall 31 which extends perpendicular to the beam axis 10 and includes a circular beam entrance aperture 51 disposed coaxially with respect to the beam axis 10. A second wall 32, which also extends perpendicular to the beam axis 10, serves as a common wall between the accelerating cavity 11 and the accelerating cavity 12. The wall 32 also includes a central circular aperture 52 which is coaxially aligned with aperture 51 along the beam axis 10. The common wall 32 additionally includes a pair of magnetic coupling apertures 62 and 62′ which are symmetrically disposed with respect to each other on opposite sides of the central aperture 52. These magnetic coupling apertures are located near the outer periphery of the wall 32, adjacent the regions in cavities 11 and 12 where the magnetic field approaches a maximum value and the electric field is very small. In principle, magnetic coupling between cavities 11 and 12 could be provided by a single coupling hole or by a plurality of coupling holes arranged, for example, in annular fashion around the outer periphery of wall 32. However, it has been found that the two diametrically opposed coupling holes 62 and 62′ as shown in FIG. 2, of a size on the same order as the size of the central beam aperture 52, will provide adequate magnetic coupling between the adjacent cavities 11 and 12 to compensate for undesirable electric coupling through the central aperture 52. The net effect of the coupling of energy from cavity 11 into cavity 12 through aperture 52 is effectively cancelled by the simultaneous coupling of energy from cavity 12 back into cavity 11 through the magnetic coupling apertures 62 and 62′. As illustrated in FIGS. 2 and 3, the edges of the apertures 51 and 52 are rounded in order to reduce the electric field gradient at these apertures to a lower value than would result if drift tubes or non-rounded iris openings were provided.

The accelerating cavity 12 includes another wall 33 which serves as a common wall between cavity 12 and the next accelerating cavity 13. The wall 33 has a central aperture 53 which is coaxial with the beam axis 10, and a pair of magnetic coupling apertures 63 and 63′ which are symmetrically disposed on opposite sides of the central aperture 53 in order to provide magnetic coupling between cavities 12 and 13 so as to compensate for any electrical coupling between these cavities through central aperture 53. The edges of the aperture 53 are rounded, as discussed above in connection with apertures 51 and 52, to reduce the electric field gradient at the iris opening between adjacent accelerating cavities.

The cavities 13, 14, 15, 16, 17, 18, 19, 20 and 21 include common walls, 34, 35, 36, 37, 38, 39, 40 and 41, respectively, disposed between adjacent cavities so that all of the cavities are aligned along the beam axis 10. The common walls 34, 35, 36, 37, 38, 39, 40 and 41 each include one of a plurality of central beam apertures 54, 55, 56, 57, 58, 59, 60 and 61, respectively, which are also coaxially aligned with each other about the beam axis 10. Each of the walls 34, 35, 36, 37, 38, 39, 40 and 41 additionally includes a pair of magnetic coupling apertures 64 and 64′, 65 and 65′, 66 and 66′, 67 and 67′, 68 and 68′, 69 and 69′, 70 and 70′, and 71 and 71′, respectively, which are symmetrically disposed on opposite sides of the central apertures 54, 55, 56, 57, 58, 59, 60 and 61, respectively, and serve to magnetically couple the adjacent accelerating cavities 13 and 14, 14 and 15, 15 and 16, 16 and 17, 17 and 18, 18 and 19, 19 and 20, and 20 and 21, respectively. This magnetic coupling of adjacent cavities compensates for any electric coupling that occurs through the central beam apertures in the walls separating the adjacent cavities. The beam apertures 54, 55, 56, 57, 58, 59, 60 and 61 are likewise rounded to reduce the electric field gradient at the iris openings between adjacent accelerating cavities. An exit wall 42 having a central beam exit aperture 80 aligned with the beam axis 10 is disposed on the opposite side of the accelerating cavity 21 from the wall 41 and serves to complete the accelerating cavity structure. It is noted that the accelerator 1 is an evacuated structure. For the embodiment shown in the drawing, it is necessary that the beam entrance aperture 51 and the beam exit aperture 80 be covered by windows which are impermeable to gas in order that vacuum-tight integrity of the structure can be maintained yet which are permeable to the beam particles at the energies at which these particles respectively enter into or exit from the accelerator 1. An alternative arrangement with respect to the beam entrance aperture 51 would be to dispose a preaccelerator structure, or the charged particle source, immediately adjacent the aperture 51, such as by a vacuum-tight flange connection, in such a way that charged particles could be injected directly through aperture 51 into the evacuated accelerator 1 without the necessity of any window material covering the aperture 51. If the accelerator is used only for very light particles (e.g., electrons) that can be collimated into a very narrow beam, it is possible for the central beam apertures to be made so small that electrical coupling between adjacent accelerating cavities will be negligible. In that case, the magnetic coupling apertures are unnecessary and can be eliminated.

The accelerating cavity 11 is inductively coupled through a side cavity 21 to the accelerating cavity 13, as shown in FIG. 2. A second side cavity 22, as shown in FIG. 3, is disposed ninety degrees around the beam axis 10 from side cavity 21 and provides similar inductive coupling between the two accelerating cavities 12 and 14. A third side cavity 23, as shown in FIG. 2, is disposed ninety degrees around the beam axis 10 beyond side cavity 22 and provides coupling between the two accelerating cavities 13 and 15. A fourth side cavity 24 is disposed ninety degrees around the beam axis 10 beyond side cavity 23 and provides coupling between the two accelerating cavities 14 and 16. In a like manner, a fifth side cavity 25 is disposed ninety degrees around the beam axis 10 beyond side cavity 24, in alignment with the side cavity 21, and provides coupling between the two accelerating cavities 15 and 17. Similarly, a sixth side cavity 26 is disposed ninety degrees around the beam axis 10 beyond side cavity 25, in alignment with the side cavity 22, and provides coupling between the two accelerating cavities 16 and 18. A seventh side cavity 27 is disposed an additional ninety degrees around the beam axis 10, in alignment with the side cavity 23, and provides coupling between the accelerating cavities 17 and 19. Similarly, an eighth side cavity 28 is disposed an additional ninety degrees around the beam axis 10 beyond side cavity 27, in alignment with the side cavity 24, and provides coupling between the two accelerating cavities 18 and 20. A ninth side cavity 29 is disposed ninety degrees further around the beam axis 10, in alignment with side cavities 21 and 25, and provides coupling between the two accelerating cavities 19 and 21.

In principle, the side cavities 21 through 29 could be configured in the conventional manner as illustrated, for example, in the aforecited article by E. A. Knapp, et al. It is preferable, however, to modify the conventional configuration of the side cavities in order to accommodate the interposition between each pair of coupled accelerating cavities of an independently energized accelerating cavity. Thus, the configuration of side cavity 22 is designed, as best shown in FIG. 3, to accommodate the interposition of accelerating cavity 13 between the accelerating cavities 12 and 14 which are electrically coupled by the side cavity 22. In particular, cavity 22, instead of being configured as a single cylinder according to the conventional manner, is configured as a combination of three coaxial cylinders 2, 3 and 2'. One end of cylinder 2 is partially bounded by wall 4, and the other end is in open communication with cylinder 3. Cylinder 3 is coaxial with but of smaller diameter than cylinders 2 and 2', and is in open communication at each end with cylinders 2 and 2' to form the interior chamber of the side cavity 22. Cylinder 2' has the same diameter and axial length as cylinder 2, and is partially bounded by wall 4' on the end opposite cylinder 3. The axial length of cylinder 3 is equal to the distance between the outside surfaces of walls 33 and 34 of the accelerating cavity 13, as seen in FIG. 3. The diameter of cylinder 3 is less than the diameter of cylinders 2 and 2' by an amount sufficient to permit cylinders 2 and 2' to have a conventionally determined diameter while allowing accelerating cavity 13 to be coaxial with and to have the same dimensions as accelerating cavities 12 and 14. Metal post 5 projecting from wall 4 and metal post 5' projecting from wall 4' are symmetrically disposed along the common axis of cylinders 2, 3, and 2' whereby the gap between posts 5 and 5' can provide the capacitance necessary for tuning the side cavity 22 to the same frequency as the accelerating cavities 12 and 14. FIG. 4 shows in detail a cross-sectional view through accelerating cavity 13 and side cavity 22. Side cavity 22 communicates with accelerating cavity 12 through iris 6 and with accelerating cavity 14 through iris 6', where irises 6 and 6' are inductive coupling irises. The other side cavities 24, 26 and 28 shown in FIG. 3, and the side cavities 21, 23, 25, 27 and 29 shown in FIG. 4, are constructed in the same manner as described above for side cavity 22. The accelerating cavities and the side coupling cavities of a particular substructure are all tuned to be resonant at essentially the same frequency. For practical application, it is contemplated that the cavities will be resonant at S-band.

As illustrated in FIG. 1, a first radio-frequency power input waveguide 102 communicates with the accelerating cavity 20 through iris 106 for coupling energy to the even-numbered accelerating cavities. The waveguide 102 comprises a rectangular guide member 103, a mounting flange 104 affixed thereto, and a radio-frequency window 105 sealed thereacross to permit passage of radio-frequency energy into the accelerating cavity 20 while forming a portion of the vacuum envelope of the accelerator 1. Similarly, a second radio-frequency power input waveguide 111, comprising a rectangular guide member 113, a mounting flange 114 and a radio-frequency window 115, communicates with the accelerating cavity 11 through iris 116 for coupling energy to the odd-numbered accelerating cavities. In principle, radio-frequency energy could be coupled to any one of the accelerating cavities of each substructure to set up a standing wave in that substructure. It is convenient, however, to locate the power input waveguides 102 and 111 at opposite ends of the accelerator 1 in order to accommodate the physical dimensions of the waveguides. Since the substructure comprising the accelerating cavities 11, 13, 15, 17, 19 and 21 is electromagnetically discoupled from the substructure comprising the accelerating cavities 12, 14, 16, 18 and 20, each substructure could be energized to support a standing wave of a different frequency. However, it is contemplated that the same frequency input power will ordinarily be coupled into each substructure. For a two-substructure accelerator as shown in the drawing, maximum energy can be transferred to the beam of charged particles, and hence the maximum output beam energy can be obtained, when the standing wave in one substructure is out of phase with the standing wave in the other substructure by $\pi/2$ (i.e., when the phase of the wave in cavity 12 lags the phase of the wave in cavity 11 by $\pi/2$) and the phase velocity is equal to the velocity of the particles through the accelerator. The injection of the charged particles into the accelerator is synchronized with the radio-frequency field in the first accelerating cavity by well-known techniques which take into account the dimensions of the cavities and the frequency of the field. For an accelerator having a number of independent substructures greater than two, the maximum output beam energy can be obtained when each successive downstream substructure is dephased to lag the next preceding upstream substructure by $\pi/N$ (where N is the number of substructures) and the phase velocity is equal to the velocity of the particles. Thus, for a charged particle beam of a given intensity, by adjusting the dephasing between adjacent accelerating cavities it is possible to adjust the output beam energy of the accelerator from a maximum value down to a value approximately equal only to the energy possessed by the particles as they enter the accelerator.

As an alternative to providing each accelerator substructure with a separate radio-frequency power input waveguide, it would be possible to energize both substructures from a single power source through a single input waveguide. For example, waveguide 102 may be eliminated and power from the substructure comprising the odd-numbered accelerating cavities may be coupled into the substructure comprising the even-numbered cavities through a coupling side cavity designed to provide the necessary phase shift in the proper direction so that the beam will experience an identical accelerating effect in the cavities of one substructure as in the cavities of the other substructure. In FIG. 5, the waveguide 102 has been eliminated and power from the accelerating cavity 21 of one substructure is coupled into the accelerating cavity 20 of the other substructure through the coupling side cavity 120 which is designed to provide a $\pi/2$ phase shift lead in the direction of forward transmission of the electromagnetic wave from accelerating cavity 21 back into accelerating cavity 20, which is the direction opposite to the direction of transmission of the beam. Thus, the phase of the electromagnetic wave in cavity 20 will lead the phase in cavity 21 by $\pi/2$. Side cavity 120 comprises three chambers 121, 122 and 123 in open communication with each other. Chambers 121 and 123 are separated by metal wall 125 so that energy from accelerating cavity 21 passes in its direction of forward transmission successively into chamber 121, then into chamber 122, and then into chamber 123, before passing into accelerating cavity 20. Chamber 122 is configured as a cylinder in the conventional manner as described, for example, in the aforementioned E. A. Knapp, et al. article, with capacitive loading members 124 and 124' projecting into the chamber 122 to provide the capacitance necessary for tuning side cavity 120 to the same frequency as the accelerating cavities 20 and 21. Chambers 121 and 123 are transmission waveguide structures. A dielectric element 126 (which could be a ceramic plate, as of alumina) is affixed as by brazing to one of the walls of cavity 121 (for example, to the inside of wall 127) to provide the $\pi/2$ phase shift in the direction of forward transmission of the radio-frequency energy from the substructure comprising the odd-numbered accelerating cavities to the substructure comprising the even-numbered accelerating cavities. FIG. 6 shows an external view of side cavity 120 taken perpendicular to the beam axis 10 with capacitive loading member 124, wall 125 and dielectric element 126 shown in dotted lines.

Although the illustrated embodiments of the invention show only two interlaced substructures, it is clear that three, four, or even more substructures might be similarly interlaced. In order to appreciate the advantages of an accelerator according to this invention, it is helpful to consider the ratio $E_p/E_o$, where $E_p$ is defined as the peak value of the electric field that will occur somewhere on the internal surfaces of the accelerator for a given input power level, and $E_o$ is defined as the average value of the electric field along the beam axis of the accelerator for that same input power level. As the input power level increases, the values of $E_p$ and $E_o$ also increase but the ratio $E_p/E_o$ remains a constant which is characteristic of the particular accelerator. The maximum permissible peak value $(E_p)_{max}$ that can be supported without radio-frequency breakdown (e.g., arcing) is determined by the operating frequency of the accelerator, the pulse length, and surface conditions of the accelerating cavities. Thus, in an accelerator having cavities dimensioned to be resonant at S-band for a pulse duration in the range from 4 to 5 microseconds, $E_p$ has a maximum permissible value $(E_p)_{max}$ of approximately 55 megavolts per meter. This value of $(E_p)_{max}$ is considered to be the maximum attainable value for $E_p$, and any attempt to increase this value by increasing the input power level will only result in radio-frequency breakdown.

In the prior art, the peak value $E_p$ was usually reached in the vicinity of the irises or the drift tube openings between adjacent accelerating cavities due to the sharp electric field gradient in these regions caused by the iris or drift tube projections. It should be noted that elimination of sharp edges on the iris openings between adjacent accelerating cavities, or elimination of the drift tubes with their projections into the adjacent accelerating cavities, would significantly reduce the electric field gradient in the region between adjacent accelerating cavities and consequently would provide a more uniform electric field intensity distribution along the beam path through the accelerator. It is a feature of this invention that thick-walled irises with sharp-edged openings are avoided, and the need for drift tubes between adjacent accelerating cavities is eliminated. Thus, in an accelerator according to the present invention, the particle beam is exposed to a relatively uniform electric field intensity throughout substantially its entire path through the accelerator except at the rounded iris openings between adjacent accelerating cavities. Techniques are presently known for making the walls between adjacent accelerating cavities thin enough so that the total of the thickness measurements of all the walls separating adjacent accelerating cavities will be small in comparison with the total path of the beam through the accelerator. The required thickness of the walls between adjacent accelerating cavities in an accelerator according to this invention is dependent only upon considerations of mechanical strength. Side-cavity coupled accelerators according to the prior art, on the other hand, rather than having thin-walled irises between adjacent accelerating cavities, generally required drift tubes between adjacent accelerating cavities in order to optimize the energy gain in each accelerating cavity. Thus, the present invention minimizes that portion of the beam path through the accelerator for which the beam experiences no accelerating electric field, thereby increasing the energy gain per unit of path length for a given average value $E_o$ of the electric field along the beam axis of the accelerator.

As well as minimizing the portion of the beam path where the accelerating electric field is zero, the present invention also provides for the beam to experience a higher average value $E_o$ of the electric field than was possible with side-cavity coupled accelerators according to the prior art. Radio-frequency breakdown occurred at lower operating power levels for prior art accelerator structures than for an accelerator according to the present invention because of the greater electric field concentrations at the entrance and exit apertures of the accelerating cavities of the prior art structures. With the present invention, input radio-frequency power can be coupled into the accelerator to higher levels without incurring electrical breakdown than was possible with prior art accelerator structures.

Where adjacent accelerating cavities are electromagnetically discoupled from each other, it is possible to adjust the phase difference between the waves in adjacent cavities. This feature of the present invention could provide a means for controlling the output energy of the beam of charged particles from the accelerator, at least in the case of small beam loading.

It has been found by experiment that the value of the ratio $E_p/E_o$ for the two-substructure accelerator of the present invention is smaller than the value of the same ratio for the prior art accelerator configuration described in the above-referenced article by E. A. Knapp, et al. by a factor of approximately two. Since $(E_p)_{max}$ is a constant for both accelerator configurations, the maximum permissible accelerating field $(E_o)_{max}$ obtainable with the two-substructure accelerator of the present invention before radio-frequency breakdown occurs is greater than for the A. E. Knapp, et al. accelerator configuration by a factor of approximately two. This doubling of the maximum permissible accelerating field that can be tolerated by the accelerator without electrical breakdown makes it possible for an accelerator according to this invention to provide an output beam with a maximum energy gain of approximately twice that obtainable with conventional standing-wave accelerator structures of the same overall length. It is, of course, necessary that an accelerator according to this invention be operated at an input power level approximately four times higher than the maximum permissible power level that conventional accelerators could tolerate without incurring electrical breakdown in order to achieve this doubling of the beam energy gain per unit accelerator length.

To appreciate the advantages of the present invention, it is instructive to consider the case of a chain of uniform idealized TM mode disc-loaded travelling-wave accelerating cavities having negligible electric coupling to adjacent cavities through the very small central beam axis apertures, with phased coupling being provided by side cavities. If, for example, the ratio $d/D$ is made equal to 0.8 (where $d$ is the distance between the inside walls of each accelerating cavity and D is the sum of $d$ plus the thickness of the wall between two adjacent accelerating cavities) and the velocity of the beam corresponds to the phase velocity of the accelerating field, then it can be shown that $E_p/E_o = D/Td$, where T, the transit-time factor, is given by $$T = \frac{\sin \phi/2}{\phi/2},$$

where $\phi = 2\pi d/\lambda$, and where $\lambda$ is the wavelength of the accelerating electromagnetic wave. The ratio $E_p/E_o$ for such an idealized disc-loaded travelling-wave accelerator can be calculated as a function of $\phi$ for a constant ratio $d/D = 0.8$ to yield the following results given in Table I below:

TABLE I

| $\phi$ | $E_p/E_o$ |
|---|---|
| 0 | 1.25 |
| $\pi/4$ | 1.27 |
| $\pi/3$ | 1.29 |
| $\pi/2$ | 1.34 |
| $2\pi/3$ | 1.41 |
| $4\pi/5$ | 1.49 |
| $\pi$ | 1.65 |

The above calculations were based on the assumption that the beam apertures between successive accelerating cavities are very small. It can be shown that the O-mode, i.e., the mode wherein $\phi = 0$, is not sensitive at all to changes in the size of the openings between adjacent accelerating cavities, but that the $\pi$-mode is extremely sensitive to even a small increase in the opening size. Thus, for the $\pi$-mode, the ratio $E_p/E_o$ depends strongly on the size of the aperture and the thickness of the wall between the cavities. For each of the other modes (i.e., $\phi = \pi/4, \pi/3, \pi/2, 2\pi/3, 4\pi/5$), the effect of a change in the aperture size is somewhere between the effects for the O-mode and the $\pi$-mode.

It can be seen from Table I that for an idealized disc-loaded side-cavity coupled travelling-wave accelerator, geometrically configured so that $d/D = 0.8$, having a phase shift of $\pi/2$ per accelerating cavity, where the beam apertures between cavities are assumed to be very small, the theoretical value of the ratio $E_p/E_o$ is 1.34. Values for the ratio $E_p/E_o$ have been experimentally determined according to the method described in an article by V. A. Vaguine entitled "Studies of Electromagnetic Hybrid Waves in Cylindrical Structures," published in CERN Yellow Report, European Organization for Nuclear Research, CERN 71-4 (1971), for a conventional disc-loaded side-cavity coupled accelerator that has been optimized with respect to energy gain, and which operates under standing-wave conditions with a $\pi$ phase shift per accelerating cavity and which has finite beam apertures between adjacent cavities. Values for the same ratio $E_p/E_o$ have likewise been experimentally determined by the same method for a non-optimized N=2 standing-wave accelerator according to the present invention, where the same general relationship, $d/D = 0.8$, was maintained, although in this case the ratio $d/D = 0.8$ is not an optimized value with respect to energy gain. For both the conventional accelerator and the two-substructure accelerator of the present invention, the beam aperture diameter was 10 millimeters. Both accelerators were energized at 2998 megahertz. Under standingwave conditions, the value of $E_p/E_o$ for the conventional accelerator was found to be 3.75 while the corresponding value for the two-substructure accelerator of this invention was found to be 1.90. The difference between the experimentally determined value of $E_p/E_0 = 1.90$ for the two-substructure standing-wave accelerator of this invention and the value of $E_p/E_o = 1.34$ for an idealized disc-loaded travelling-wave accelerator can be attributed to the concentration of the electric field in the vicinity of the finite beam apertures of the accelerating cavities of the experimental apparatus. A more refined theoretical calculation taking into account the non-negligible size of the beam apertures of the idealized disc-loaded accelerator would show that the value of $E_p/E_o$ for the two-substructure standing-wave accelerator of the present invention approximates very closely the value of $E_p/E_o$ for an idealized $\pi/2$-mode disc-loaded travelling-wave accelerator of similar geometrical configuration. It is clear that the value of $E_p/E_o$ for the two substructure standing-wave accelerator of the present invention ($E_p/E_o = 1.90$) is lower than the corresponding value of $E_p/E_o$ for a conventional side-cavity coupled standing-wave accelerator ($E_p/E_o = 3.75$) by a factor of approximately two.

For a standing-wave accelerator having N interlaced substructures according to the present invention, with each substructure operating in the $\pi/2$-mode, it is possible to determine the electric field distribution and to calculate other pertinent parameters that correspond to the parameters of a disc-loaded travelling-wave accelerator of similar geometrical configuration. The maximum possible energy gain of a beam per unit length for a given accelerator configuration is determined by the average value $E_o$ of the electric field that can be maintained along the beam axis of that accelerator. Thus, based upon the experimentally determined maximum permissible peak value of $(E_p)_{max} = 55$ megavolts per meter, the expected maximum possible accelerating field, $(F_o)_{max}$, expressed in megavolts per meter, for each of several accelerator configurations according to this invention is given in Table II below for N = 1, 2, 3 and 4, where N = 1 is a conventional configuration, N = 2 is a two-substructure configuration, N = 3 is a three-substructure configuration, and N = 4 is a four-substructure configuration.

TABLE II

| N | $(E_o)_{max}$ |
|---|---|
| 1 | 14.7 MV/m |
| 2 | 28 MV/m |
| 3 | 36 MV/m |
| 4 | 41 MV/m |

As can be seen from Table II, the maximum possible energy gain per unit length may be expected to increase as the number of interlaced substructures N increases.

The energy gain of a charged particle in an accelerating cavity is proportional to the square root of the shunt impedance of that cavity. It is therefore desirable to maximize the shunt impedance of the accelerating cavities of a linear accelerator in order to maximize the energy gain of the beam. The shunt impedance in an accelerating cavity is a function represented by the product $R_oT^2$, where $R_o$ is a factor determined by the quality factor Q of the cavity and T is the transit-time factor determined by the velocity of the particles, the length of the accelerating gap in the cavity and the frequency of the standing electromagnetic wave. The relationship between $R_o$ and T is complicated, but in general $R_o$ can be increased only when T is decreased and vice versa. Consequently, an optimum accelerator configuration for a particular type of particle must take into account the countervailing effects represented by the factors $R_o$ and T. For example, as the number N of substructures increases, the accelerating gap across each cavity generally decreases so that the transit-time factor T improves. However, reduction in the length of the accelerating cavities causes an increase in the electrical losses in the accelerator, thereby worsening the Q of the accelerator and adversely affecting the factor $R_o$. The type of particle to be accelerated is significant in selecting the optimum accelerator configuration because of the effect of the particle mass on the time of flight of the particle across the accelerating gap.

For relativistic particles (e.g., electrons), with present techniques for maximizing the Q of the accelerating cavities of a linear accelerator, there may be no advantage in increasing the number of substructures to more than N = 2. An increase in the number of substructures could not substantially improve the transit-time factor by decreasing the time of flight across the accelerating gap, but could significantly increase the electrical losses in the accelerator. On the other hand, for slow moving heavier particles (e.g., ions), the improvement in the transit-time factor that would result from increasing the number of substructures could more than counterbalance the effect of the electrical losses that might thereby be introduced into the system. It has been found that the shunt-impedance for a non-optimized two-substructure $\pi/2$-mode side-cavity coupled standing-wave linear accelerator according to the present invention is approximately ten percent higher than for a conventional $\pi/2$-mode side-cavity coupled standing-wave linear accelerator that has been optimized with respect to the $R_oT^2$ parameter. This greater shunt-impedance is due to the substantially higher value of T for the two-substructure accelerator of the present invention.

A comparison between the value of certain pertinent parameters for a conventional side-cavity coupled accelerator that is optimized with respect to shunt impedance and the values of these same parameters for a non-optimized two-substructure accelerator according to the present invention is provided below in Table III. Both the optimized conventional accelerator and the non-optimized accelerator according to this invention are energized at a frequency of 2998 megahertz, and both have an overall length of 27.5 centimeters and a central beam aperture between accelerating cavities of 10 millimeters. The maximum permissible peak value $(E_p)_{max}$ that can be supported without radio-frequency breakdown is the same for each type of accelerator structure, and the accelerating cavities for both types are designed to transport an electron beam current of 200 milliamperes. The conventional accelerator comprises five full-sized accelerating cavities, plus a half-sized beam entrance cavity designed to allow the injected electrons to enter the accelerator at a position of nearly maximum intensity of the spatial distribution of the electric field in order to optimize the bunching effect of the accelerating field upon the electrons. This technique is well-known in the prior art, and is discussed in U.S. Pat. No. 3,546,524. The accelerator according to this invention comprises two electromagnetically discoupled substructures, one substructure having five accelerating cavities and the other having six accelerating cavities.

TABLE III

| PARAMETER | CONVENTIONAL ACCELERATOR | N = 2 ACCELERATOR OF THIS INVENTION |
|---|---|---|
| Quality Factor (Q) | 15500 | 11000 |

TABLE III-continued

| PARAMETER | CONVENTIONAL ACCELERATOR | N = 2 ACCELERATOR OF THIS INVENTION |
|---|---|---|
| Time-transit factor | 0.760 | 0.935 |
| Effective shunt-impedance (megaohms per meter) | 78.4 | 85.0 |
| $E_p/E_e$ (under standing-wave conditions) | 3.75 | 1.90 |
| Maximum energy gain per unit length (megavolts per meter) | 14.7 | 29.0 |
| Maximum output electron beam energy (megavolts) | 4.0 | 8.0 |
| Design energy (megavolts) | 4.0 | 4.0 |
| Design beam current (milliamperes) | 200 | 200 |
| Radio-frequency beam power (megawatts) | 0.80 | 0.80 |
| Radio-frequency power losses (megawatts) | 0.74 | 0.62 |
| Total input radio-frequency power (megawatts) | 1.54 | 1.42 |
| Maximum permissible radio-frequency power for the 200 milliampere beam (megawatts) | 1.54 | 5.68 |

At low input power levels, the output beam energy for the non-optimized accelerator according to this invention is about 5% to 10% higher than for the conventional accelerator operating under the same conditions. The most dramatic advantage of this invention over the prior art, however, is observed as the input radio-frequency power was raised. The two-substructure accelerator of the present invention can tolerate as input power level more than three times higher than the conventional accelerator can tolerate without incurring radio-frequency breakdown. Thus, the accelerator of this invention can impart to an electron beam almost twice the energy gain that was possible with a conventional accelerator of the same overall length.

For the two-substructure accelerator of the present invention, the quality factor Q for each accelerating cavity is not as good as for the conventional accelerator. However, for the two-substructure accelerator of the present invention, the electron beam experiences an accelerating electric field throughout substantially the entire length of the accelerator, whereas for the conventional accelerator, the electron beam experiences an accelerating field for only two-thirds of the length of the accelerator because of the shielding effect of the drift tubes. In the accelerator of the present invention, the poorer quality factor Q of the accelerating cavities is more than compensated for by the increase in exposure of the electron beam to the accelerating field. The most significant contribution to the shunt impedance of an accelerating cavity is that provided by the second power of the transit-time factor T. A comparison of $T^2$ for each type of accelerator structure yields the ratio 0.874/0.576 in favor of the accelerator of the present invention over the conventional accelerator. Rough comparisons like these, which are conservative in favor of the conventional accelerator, indicate the inherent superiority of an accelerator according to present invention over the conventional accelerator. It will be appreciated that for beams of heavier particles, the transit-time factor in a conventional accelerator is less than for electron beams. Thus, an accelerator having a plurality of electromagnetically discoupled substructures according to the present invention can provide an even greater improvement over the prior art with respect to shunt impedance for heavy particle beams than it can for electron beams. A particular number N of substructures can be found which will optimize the countervailing effects which increasing $T^2$ and decreasing $R_o$ have on the energy gain per unit path length of the particular type of particles passing through the accelerator. For electron beams, it is likely that N = 2 is optimum because higher numbers of substructures will decrease the quality factor Q of the accelerator structure without improving the transit-time factor T. For heavier particles, however, higher values of N might be appropriate.

At low power levels, where radio-frequency breakdown is not a problem, the present invention provides an improvement over the prior art with respect to the energy gain per unit accelerator length that can be imparted to a beam of charged particles. At higher power levels, however, the present invention is greatly superior to any accelerator known to the prior art. In particular, an accelerator according to the present invention can operate at power levels greatly exceeding the level at which prior art accelerators suffer radio-frequency breakdown. Consequently, an accelerator according to the present invention can provide a far higher average value for the accelerating field along the particle path through the accelerator, and hence can impart a far higher energy gain to the particles being accelerated, than is possible with accelerators known to the prior art.

A notable advance in the standing-wave accelerator art occurred when it was realized that the coupling cavities could be removed from the beam path and disposed as side cavities. This made possible a significant increase in the energy gain of the beam per unit accelerator length for a given input radio-frequency power level. Removal of the coupling cavities from the beam axis led to an expansion of the accelerating cavities in the dimension of the beam axis, which in turn led to the introduction of drift tubes between adjacent accelerating cavities. In a side-cavity coupled accelerator structure with drift tubes that is optimized with respect to shunt impedance, the beam is exposed to the accelerating electric field for only about two-thirds of the length of the accelerator - which was, of course, a notable improvement over the earlier accelerator configurations wherein the coupling cavities on the beam axis prevented exposure of the beam to the accelerating electric field for half of the length of the accelerator. A multisubstructured accelerator configuration according to the present invention is a further notable improvement in the standing wave accelerator art because it makes possible the exposure of the beam to the accelerating electric field for substantially the entire length of the accelerator, limited only by the thickness of the walls between adjacent accelerating cavities. Thus, for a desired beam output energy, an accelerator according to the present invention can be shorter in overall length than any accelerator known to the prior art. This efficient use of space is particularly important in radio-therapy apparatus.

Although this invention has been described with respect to preferred embodiments, it will be readily apparent to those skilled in the art that various changes in form and arrangement of parts may be made to suit requirements without departing from the spirit and scope of the invention as defined by the following claims.

What is claimed is:

1. A charged particle standing wave accelerator comprising wall means forming at least three accelerating cavities, each said accelerating cavity being adapted to support a standing wave therein, said wall means having apertures between adjacent cavities to permit passage of a charged particle beam along a path through said accelerating cavities, coupling means directly interconnecting two of said accelerating cavities which are not adjacent to each other and adapted to cause a phase difference in said two cavities, said coupling means being disposed from said beam path and having no coupling connection to any accelerating cavity between said two accelerating cavities, at least a third accelerating cavity positioned between said two accelerating cavities, means for driving one of said two accelerating cavities with a source of electromagnetic wave energy, and means other than said beam for driving said third accelerating cavity with a source of electromagnetic wave energy which can have a selected phase relation to said source for driving one of said two cavities; whereby said two accelerating cavities form a first accelerating cavity substructure, said third accelerating cavity forms a second accelerating cavity substructure, and said two substructures can be energized with input waves having a selected phase relation to each other.

2. The accelerator of claim 1 wherein said coupling means between said two accelerating cavities comprises a resonant coupling cavity.

3. The accelerator of claim 2 wherein said two accelerating cavities and said coupling cavity have substantially the same resonant frequency.

4. The accelerator of claim 1 wherein said means for driving one of said two accelerating cavities comprises a first input waveguide coupled to a source of electromagnetic energy separate from said accelerator, and said means for driving said third accelerating cavity comprises a second input waveguide coupled to a source of electromagnetic energy separate from said accelerator.

5. A charged particle standing wave accelerator comprising wall means forming a plurality of accelerating cavities, each said accelerating cavity being adapted to support a standing wave therein, said wall means having apertures between adjacent cavities to permit passage of a charged particle beam along a path through said accelerating cavities, first resonant cavity coupling means displaced from said beam path and interconnecting a first group of non-adjacent ones of said accelerating cavities to form a first substructure comprising plural accelerating cavities, at least a second resonant cavity coupling means displaced from said beam path and interconnecting a second group of non-adjacent ones of said accelerating cavities to form at least a second substructure comprising plural accelerating cavities, said first coupling means comprising a separate resonant coupling cavity directly interconnecting each two of the most nearly adjacent accelerating cavities of said first group and adapted to cause a phase difference in the two interconnected accelerating cavities, said second coupling means comprising a separate resonant coupling cavity directly interconnecting each two of the most nearly adjacent accelerating cavities of said second group and adapted to cause a phase difference in the two interconnected acceleration cavities, the acceleration cavities of said first group being interlaced with the accelerating cavities of said second group, drive coupling means connected to one of said first group of accelerating cavities for driving said first substructure with electromagnetic wave energy, and drive coupling means connected to one of said second group of accelerating cavities for driving said second substructure with electromagnetic wave energy.

6. The accelerator of claim 5 further comprising means for energizing said drive coupling means with electromagnetic wave energy having a different phase for adjacent substructures.

7. The accelerator of claim 5 wherein magnetic coupling apertures are provided in the walls separating adjacent accelerating cavities of different substructures to compensate for any electric coupling occurring through said particle apertures.

8. The accelerator of claim 5 wherein each coupling cavity comprises three cylindrical portions which are coaxial about an axis, said cylindrical portions being in open communication with each other, the diameters of two of said cylindrical portions being substantially identical with each other and the diameter of the third cylindrical portion being smaller than the diameters of said other two cylindrical portions, said smaller-diameter cylindrical portion being intermediate said other two cylindrical portions along said axis, and said larger-diameter cylindrical portions of said coupling cavity being respectively coupled to its non-adjacent accelerating cavities.

9. The accelerator of claim 8 further comprising facing posts coaxially arranged on said axis and connected respectively to the walls of said larger diameter cylindrical portions, and said posts each extending into said smaller diameter cylindrical portions.

10. The accelerator of claim 5 wherein each of said drive coupling means comprises a waveguide, and electromagnetic wave source means separate from said accelerator connected to said waveguides for driving said plural substructures with input waves having a selected phase relation between adjacent substructures.

11. The accelerator of claim 5 wherein one of said drive coupling means comprises a waveguide connected to an electromagnetic source separate from said accelerator, and the other of said drive coupling means comprises a phase shifting connection from an accelerating cavity of one of said substructures to an accelerating cavity of another of said substructures.

12. The accelerator of claim 5 wherein all of said accelerating cavities and all of said coupling cavities all have substantially the same resonant frequency.

13. A charged particle standing wave accelerator comprising wall means forming a plurality of accelerating cavities, each said accelerating cavity being adapted to support a standing wave therein, said wall means having apertures between adjacent cavities to permit passage of a charged particle beam along a path through said accelerating cavities, first resonant cavity coupling means displaced from said beam path and interconnecting a first group of non-adjacent ones of said accelerating cavities to form a first substructure comprising plural accelerating cavities, second resonant cavity coupling means displaced from said beam path and interconnecting a second group of non-adjacent ones of said accelerating cavities to form a second substructure comprising plural accelerating cavities, at least a third resonant cavity coupling means displaced from said beam path and interconnecting a third group of non-adjacent ones of said accelerating cavities to form at least a third substructure comprising plural accelerating cavities, said first coupling means comprising a separate resonant coupling cavity directly interconnecting each two of the most nearly adjacent accelerating cavities of said first group and adapted to cause a phase difference in the two interconnected accelerating cavities, said second coupling means comprising a separate resonant coupling cavity directly interconnecting each two of the most nearly adjacent accelerating cavities of said second group and adapted to cause a phase difference in the two interconnected accelerating cavities, said third coupling means comprising a separate resonant coupling cavity directly interconnecting each two of the most nearly adjacent accelerating cavities of said third group and adapted to cause a phase difference in the two interconnected accelerating cavities, the accelerating cavities of the several substructures being positioned in interlaced arrangement so that each most nearly adjacent accelerating cavities of a given substructure are separated by an accelerating cavity from each of the other substructures, drive coupling means connected to one of said accelerating cavities in said first substructure for driving said first substructure with electromagnetic wave energy, drive coupling means connected to one of said accelerating cavities in said second substructure for driving said second substructure, and drive coupling means connected to one of said accelerating cavities in said third substructure for driving said third substructure.

14. The accelerator of claim 13 wherein the number of said substructures range in number from one to N, and means for energizing said drive coupling means with electromagnetic wave energy having a different phase for adjacent substructures.

* * * * *